US005471556A

United States Patent [19]

Friedheim

[11] Patent Number: 5,471,556

[45] Date of Patent: Nov. 28, 1995

[54] SUPERHEATED VAPOR GENERATOR AND CONTROL SYSTEM AND METHOD

[76] Inventor: Max Friedheim, P.O. Box 99838, San Diego, Calif. 92169

[21] Appl. No.: 93,071

[22] Filed: Jul. 16, 1993

[51] Int. Cl.[6] ..... F22B 1/02; F22B 1/28

[52] U.S. Cl. ..... 392/399; 392/396

[58] Field of Search ..... 392/399, 401–406, 392/396; 122/40; 38/77.9, 77.6

[56] References Cited

U.S. PATENT DOCUMENTS

| | | | |
|---|---|---|---|
| 377,228 | 1/1888 | Bartlett | 122/40 |
| 2,026,422 | 12/1935 | Fielding | 38/77.6 |
| 2,505,656 | 4/1950 | Wagner . | |
| 2,576,976 | 12/1951 | Stagmer | 392/396 |
| 2,652,645 | 9/1953 | Youhouse | 38/77.9 |
| 2,753,212 | 7/1956 | Aultman | 122/404 X |
| 2,861,838 | 11/1958 | Wyatt et al. . | |
| 2,886,689 | 5/1959 | Garth | 392/401 |
| 2,938,450 | 5/1961 | Norris et al. . | |
| 3,039,454 | 6/1962 | Gilbertson et al. | 239/136 X |
| 3,119,004 | 1/1964 | Hoop | 122/40 X |
| 3,218,741 | 11/1965 | Martin | 122/40 X |
| 3,436,852 | 4/1969 | Stansbury | 38/77.6 |
| 3,508,354 | 4/1970 | Stansbury et al. | 38/77.6 |
| 3,718,805 | 2/1973 | Posey . | |
| 3,721,802 | 3/1973 | Chrisman | 392/399 |
| 3,823,497 | 7/1974 | Solomon | 38/77.6 |
| 3,869,815 | 3/1975 | Bullock | 38/77.6 |
| 4,255,646 | 3/1981 | Dragoy et al. | 392/399 X |
| 4,414,037 | 11/1983 | Friedham | 392/399 X |

*Primary Examiner*—Teresa J. Walberg
*Attorney, Agent, or Firm*—Joseph R. Evanns

[57] ABSTRACT

A superheated vapor generator and control system includes a vapor generator having an interior vapor generating chamber with peripheral surfaces having a plurality of ridges and grooves, preferably of substantially randomly varying heights and depths and preferably having a plurality of grooves and ridges intersecting the first-mentioned grooves and ridges, the second-mentioned ridges and grooves preferably varying substantially randomly in height and depth. A hand-held control member includes parts for controlling generation of superheated vapor and for directing such vapor to desired objects. A method for fabricating a superheated vapor generator includes machining inner portions of sections of heat conductive material to form grooves and ridges and then welding the parts together to form a closed interior vapor generation chamber.

41 Claims, 6 Drawing Sheets

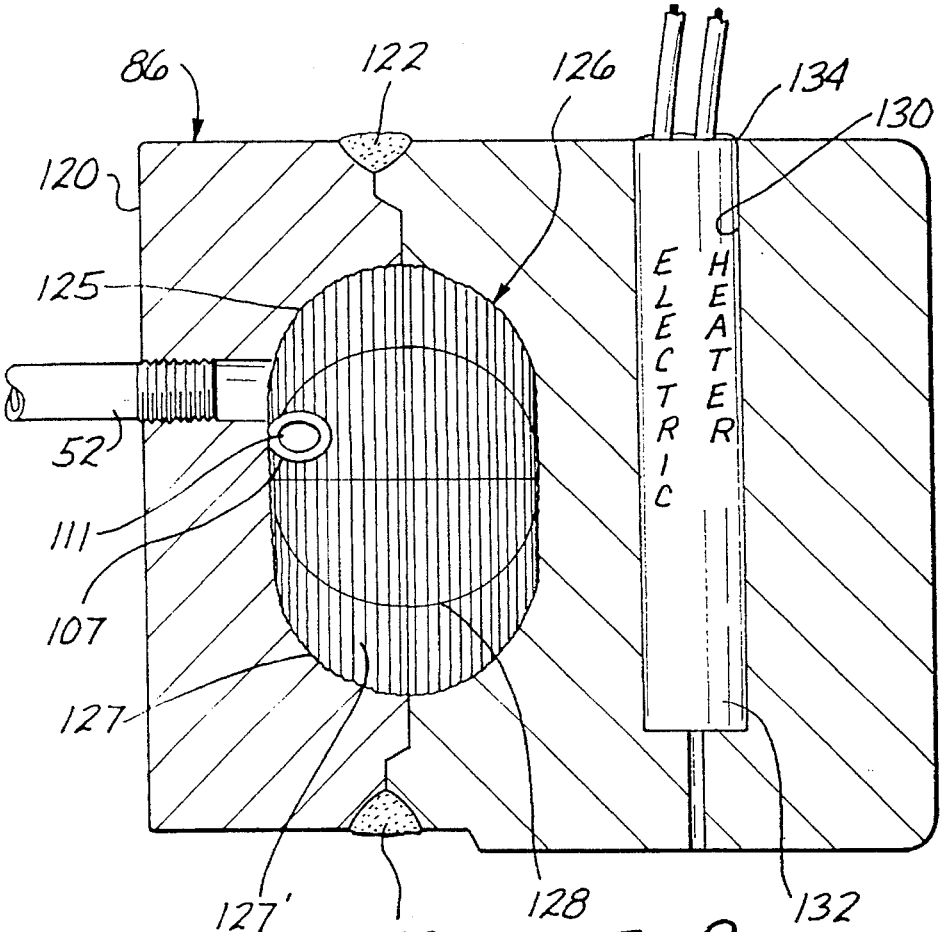
Fig. 8
Fig. 10
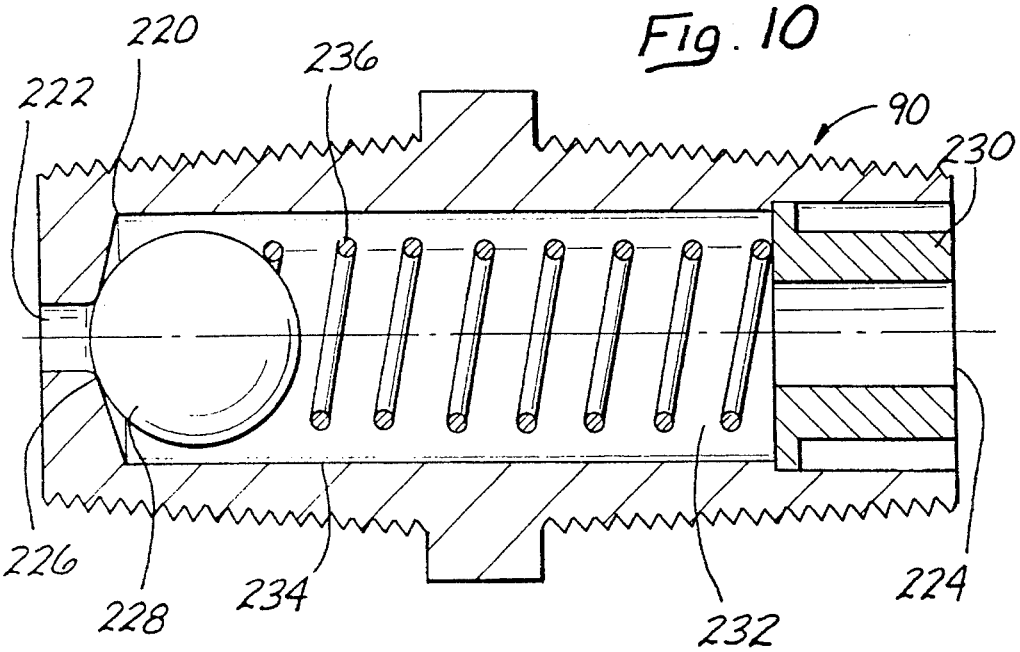

SUPERHEATED VAPOR GENERATOR AND CONTROL SYSTEM AND METHOD

BACKGROUND OF THE INVENTION

1. Field of the Invention

The invention pertains to a system for rapid generation of superheated vapor such as superheated steam and for controlling and directing superheated vapor and further relates to a method for fabricating means for generating superheated vapor.

2. Description of the Prior Art

Prior art patents include U.S. Pat. No. 4,414,037, owned by the inventor and applicant herein, and prior art references cited in connection with the aforesaid U.S. Pat. No. 4,414,037 including U.S. Pat. Nos. 2,505,656; 2,753,212; 2,861,838; 2,983,450; 3,039.454; 3,218,741; 3,718,805; and 3,721,802.

The aforesaid patents in the main refer to apparatus for generating steam from liquid drawn from a reservoir.

U.S. Pat. No. 4,414,037 (the '037 patent) to the inventor herein discloses apparatus for generating superheated steam or other vapor from water drawn from a self-contained reservoir and includes means in the form of a nozzle for directing superheated steam to desired objects. The apparatus disclosed and claimed in the aforesaid patent is directed to a system for accomplishing, among other things, cleaning and sterilization, the mixture drawn from the reservoir being a cleaning solution or a disinfectant. The device of the '037 patent employs a nozzle positioned adjacent the cover of the device for directing the spray of superheated vapor, under the control of a foot switch whereby the intake and output of steam is regulated. The steam chamber comprises walls having point-like irregularities etched into the surface thereof by etching solution, as a result of which the production of vapor from input fluid is expedited as opposed to steam generation from a smooth-walled chamber. The chamber could be fabricated only of aluminum, due to the chemical process employed in etching the irregularities into the chamber walls. In addition, the device of the '037 patent delivers a uniformly relatively dry mixture of superheated vapor, which was advantageous in a number of applications.

The device of the '037 patent has been highly successful in numerous applications, including cleaning and sterilization of numerous objects such as large and small machinery and medical equipment. However, it has been found that improved results and more general applicability could be achieved through a superheated vapor generator and control system which would produce superheated vapor such as steam even more rapidly than the existing device and would in addition afford the capability of greater convenience and mobility, and more precise control in terms of regulating and directing the flow of superheated fluid. In addition, it has been found in particular applications that regulation of moisture (i.e. liquid) content of the superheated vapor is of moment.

Therefore, there has been a felt but unfulfilled need for a generator of superheated vapor, including steam, having a capability for regulating the amount of liquid in the superheated vapor, having a capability for more convenient control of generating and directing a superheated vapor to designated objectives especially those which may be small or relatively inaccessible, with a means for accomplishing rapid and efficient conversion of liquid to superheated vapor, and with means for remote acquisition of liquid for directing said into the vaporization chamber. In addition, there is a felt but unfulfilled need for a more efficient vaporization chamber, as well as a method for fabricating such generators.

SUMMARY OF THE INVENTION

A system for generating and controlling superheated vapor comprises at least one vapor generator member defining an internal vaporizing chamber having a peripheral surface at least a portion of which includes a plurality of ridges and grooves the heights and depths of which may vary substantially randomly within a selected range which ridges and grooves may include a portion which intersect with other ridges and grooves the height and depth of said intersecting ridges and grooves being also substantially randomly varied.

A control member is connectable to the vapor generator member and includes a means such as a nozzle to direct the flow of superheated vapor to a desired objective and further includes control means for controlling intake of liquid into the vapor generator member thereby controlling the superheated vapor generator.

At least one check valve at the liquid intake can be employed to vary the liquid content of the superheated vapor generated by the system, through adjustment of the spring tension in said check valve.

Due to the ridge and groove configuration of the periphery of the vaporization chambers, vapor generators in accordance with the invention can be fabricated of aluminum or other suitable thermally conductive material.

A method of fabricating vapor generators in accordance with the invention includes the steps of providing at least two sections fittable together to form a closed interior volume, milling the interior walls of said sections to form a plurality of ridges and grooves and then welding the sections together.

DETAILED DESCRIPTION OF THE DRAWINGS

FIG. 8 is a sectional view taken along the line 8—8 of FIG. 5;

FIG. 9 is a diagram of electrical circuitry employed with the invention;

FIG. 10 is a sectional view taken along the line 10—10 of FIG. 2; and, FIG. 11 is a schematic diagram of a method in accordance with the invention.

DETAILED DESCRIPTION OF THE INVENTION

Figure 1:
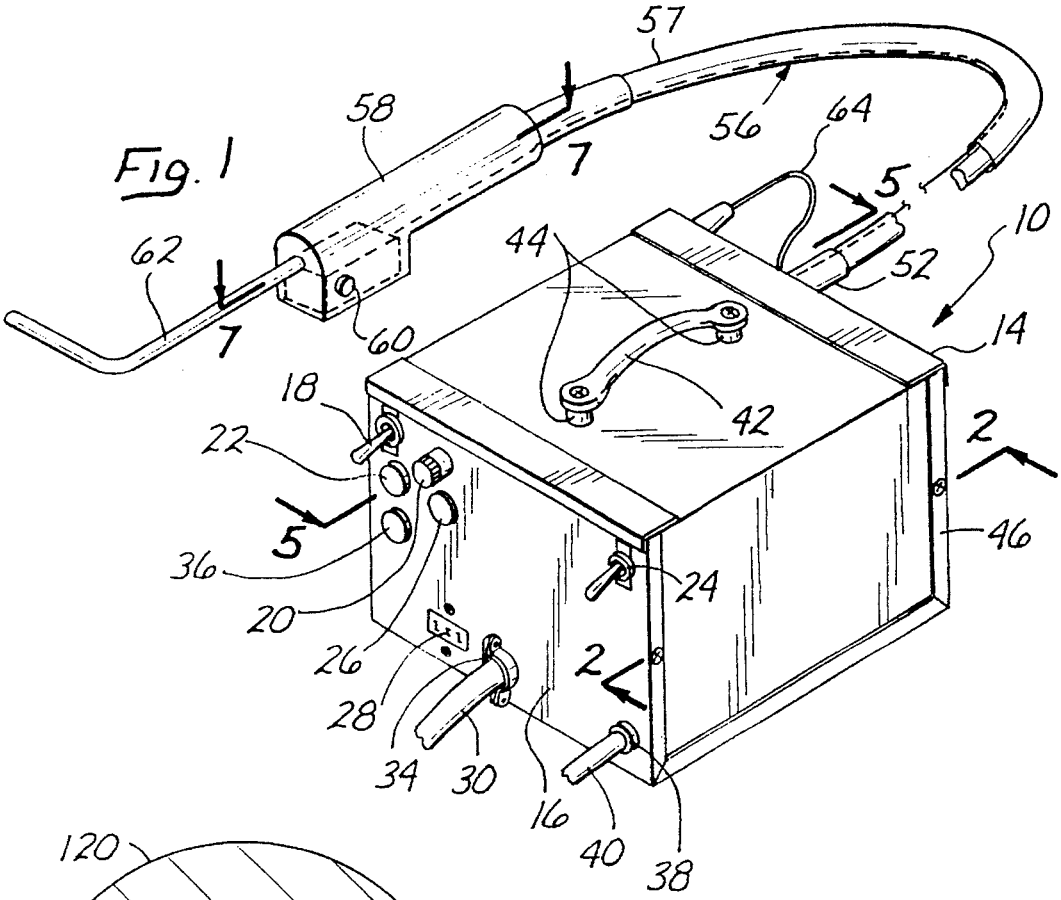
FIG. 1 is a perspective view of a system in accordance with the invention.
Figure 2:
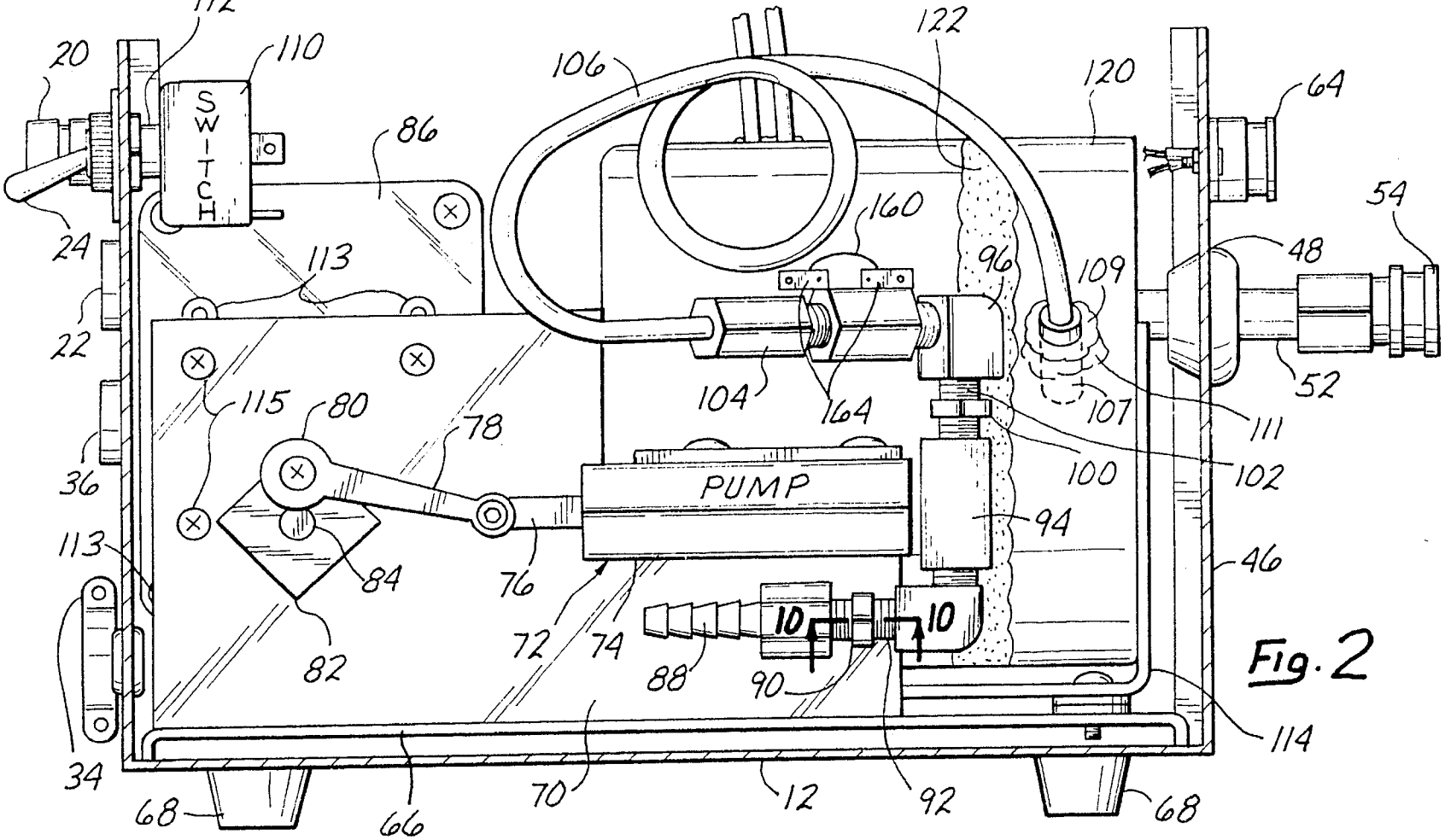
FIG. 2 is a section through the line 2—2 of FIG. 1.
Figure 5:
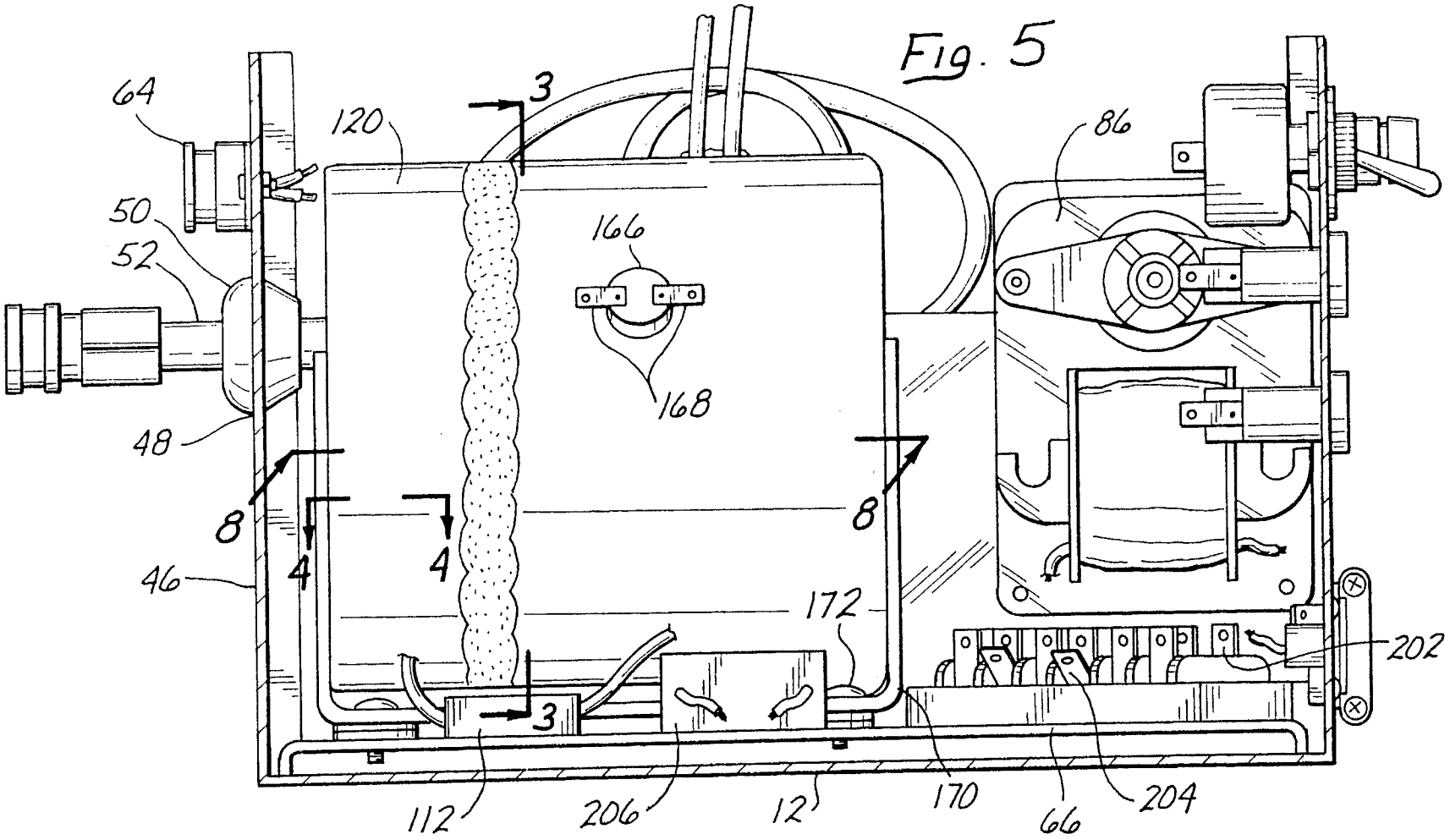
FIG. 5 is a sectional view taken along the line 5—5 of FIG. 1.

Referring to FIGS. 1, 2 and 5, a superheated vapor generating and control apparatus 10 includes a base 12 forming the bottom of a housing 14. The housing 14 together with the base 12 functions as a container for the system 10. The top and sides of the container of housing 14 are fastened to the base by conventional means such as screws and are removable to permit access to the interior of system 10.

Controls of the system 10 are disposed upon a portion of housing 14 comprising a control panel 16. A power switch 18 is conveniently disposed on panel 16 and comprises a bi-polar arrangement of conventional type, controlling drawing of power from an external source i.e. whether the system 10 is "On" or "Off"as is more fully described hereinbelow.

Disposed upon control panel 16 adjoining power switch 18 is a removable line fuse holder 20. A white power light 22 is disposed on control panel 16 and as described in more detail hereinbelow functions to indicate power in the system 10.

Also disposed on the control panel 16 is a manual vapor heating switch 24 which participates in controlling the generation of steam and/or superheated vapor as described herein. An amber vapor generator light 26 is disposed on the control panel 16 adjacent power indicator 22. Light 26 as described hereinbelow is an indicator of the operation of thermostats of a vapor generator (described in more detail below) in the system 10.

A footswitch electric receptacle 28 is disposed in a lower part of panel 16 and accommodates a foot switch (not shown) for controlling superheated vapor production.

A power line 30 is accommodated in a fitting 32 attached to the panel 16 around a slot 34 for passage therethrough of the power line 30.

An amber heating chamber light 36 is positioned on panel 16 adjacent power light 22 and is electrically connected as described hereinbelow to remain on while a heating element described below is drawing current. A liquid pick-up tube inlet 38 is defined in control panel 13 to receive a liquid pick-up tube 40.

At the top of housing 14 is disposed a carrying handle 42 secured by fasteners 44 to housing 14. In a rear panel 46 of housing 14, an aperture 48 is defined; secured on both sides of aperture 48 is a gasket-type fitting 50. Aperture 48 and gasket 50 accommodate and receive a vapor exit pipe connector 52. A quick disconnect connector member 54 is disposed at an outer end of pipe 52 and connectable to a vapor control member or wand 56. The wand 56 contains a grip handle 58 in which is disposed a vapor control switch operable by a vapor control push button 60. A tube 62 extends outwardly from the control member handle 58. A vapor control power connector 64 connects between the vapor control 60 and into a socket 64 and is mounted in rear panel 46.

Turning now to FIG. 5, a support plate 66 is fastened to base 12, which in turn rests upon feet 68.

A mounting plate 70 is fastened to support 66. Fastened to mounting plate 70 is a pump 72. Pump 72 includes a cylinder 74 receiving a piston 76 which reciprocates within cylinder 74. Piston 74 is pivotably and connected to a rod 78 with a pivoting member 80 at the opposite end of the rod from the pivotable connection between the rod 78 and the piston 76. A substantially square cam 82 is pivotably attached to pivot member 80 and pivots and is rotatable on a shaft 84 mounted and pivotably journalled in plate 70. In particular applications, cam 82 is at least ⅞ inch square. This configuration of the cam 82 has been found to add leverage beyond that achieved by the device in the '037 patent and to eliminate possible vapor-lock in the fluid line as fluid enters the vaporization chamber, in addition to providing more efficient prevention of back pressure of steam build-up within the vaporization chamber. This is of moment in system 10 due to the substantial heat generated in a smaller area than in the device of the '037 patent.

An electric motor 86 is mounted upon mounting plate 70 and rotates shaft 84. Electric motor 86 is Class B wired to withstand heat generated in system 10. Cam 82 is rotated by shaft 84, which in turn rotates on a sleeve in pivot member 80. An inlet fitting 88 accommodates inflow of liquid from inlet port 38 through inlet conduit 40. A first check valve 90 is connected to inlet fitting 88 and is shown in detail in FIG. 12. As described in further detail herein below in connection with FIG. 11, check valve 90 not only blocks backflow and prevents intake of solids into the apparatus but also affects by particular parameters the liquid content of superheated vapor produced by system 10.

An elbow fitting 92 is connected to check valve 90 and accommodates flow of liquid therethrough to a T-fitting 94. T-fitting 94 is connected to the fluid intake inlet 88. Connected to T-fitting 94 is a second check valve 100 which in turn is connected to an elbow fitting 96. Check valve 100, is identical to and is described in detail hereinbelow in conjunction with the description of check valve 90.

From fitting 96 fluid passes through a fitting 104 which is connectable to a tube 106, depicted as coiled for economy of space utilization. Tube 106 leads into a superheated vapor generator 120. A sleeve 107 is secured to tube 106 at its point of entry into generator 120. Sleeve 107 is preferably composed of aluminum and is welded to tube 106. Sleeve 107 preferably extends substantially ¾" above the top surface of generator 120 and is secured to generator 120 at an exterior weld 109 and an interior weld 111.

A male connector 110 is fastened to screw 112 mounted in panel 16 and connected to vapor switch 24. A bracket 114 fastened to plate 12 provides support and mounting for the vapor generator 108.

Electric gear motor 86 is secured by fasteners 115 to mounting bracket 70. Electric gear motor 86 is of conventional type and in a preferred embodiment provides 366 RPM at 115 volts. Motor 86 drives pump 72 by means of cam 82 journalled on shaft 84 which in turn is driven by motor 86. A pair of buffer members 113 upon motor 106 are in contact with bracket 70 for the purpose of minimizing the effect of vibration upon the structure.

Figure 3:
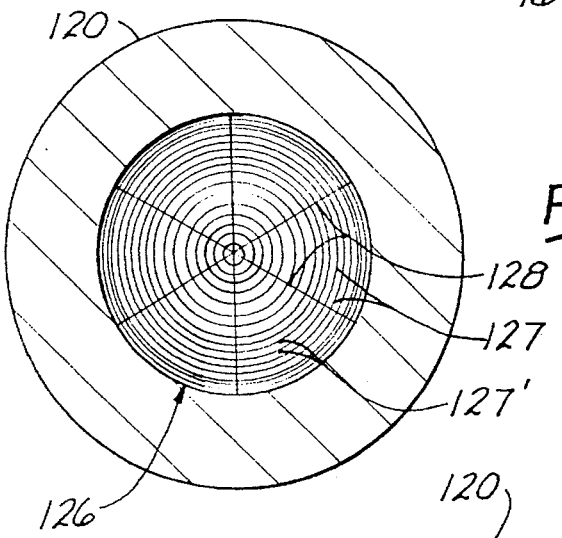
FIG. 3 is a section of a vapor generator member in accordance with the invention taken along the line 3—3 of FIG. 5.
Figure 4:
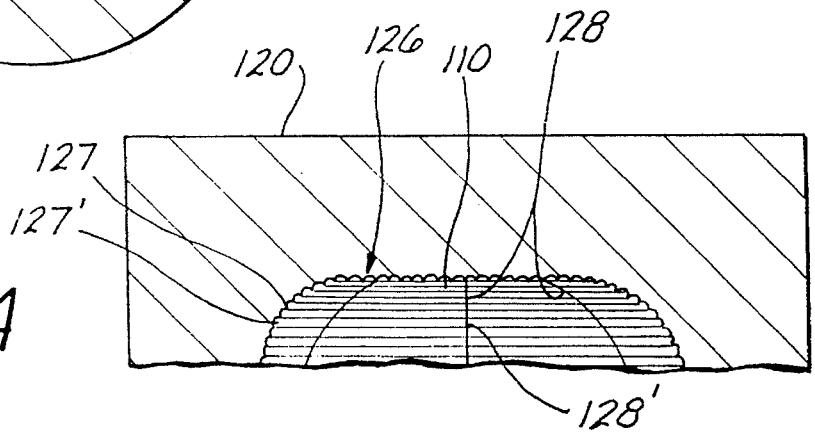
FIG. 4 is a partial sectional view of a vapor generator member in accordance with the invention taken along the line 4—4 of FIG. 5.

Referring in particular to FIGS. 3, 4, and 8, vapor generator 120 comprises metal castings in two parts welded together at 122 defining a vaporization chamber 126. Generator 120 is detachably positioned within housing 14 and is secured thereto at bracket 114 as noted hereinabove, and rests on washers 124 between plate 66 and bracket 114. A vaporization chamber 126 is defined centrally within generator 120. The bottom section is longer to allow room for a heating element 132 described below. As depicted, chamber 126 is substantially spherical; however, other configurations may be employed in accordance with the invention. In the depicted spherical configuration, the periphery of chamber 126 is referred to on occasion as a wall. In other configurations in accordance with the invention such periphery may comprise more than one wall.

The peripheral surface 125 of chamber 126 is cut in a plurality of ridges and grooves 127, 127' respectively. The depth of the grooves 127' and the height of the ridges 127 are irregular, with the height and depth in a preferred embodiment varying substantiall randomly between 0.030–0.050 inch. The ridges and grooves 127 are in the form of substantially concentric circles about an axis of generator 120.

In addition, cross-grain series of ridges and grooves are defined in the wall 125 of chamber 126 and denoted by numerals 128, 128', respectively The cross-grain ridges and grooves 128, 128' are, like the ridges and grooves 127, 127' of random and irregular dimensions. Ridges and grooves 128, 128' vary in the preferred embodiment randomly between 0.020 and 0.050 inch. It has been found that the groove and ridge configuration together with irregularities in the the depth of the grooves and the height of the ridges provides improved efficiency of vapor generation as, for example, more rapid vaporization with comparable or smaller energy consumption.

Figure 6:
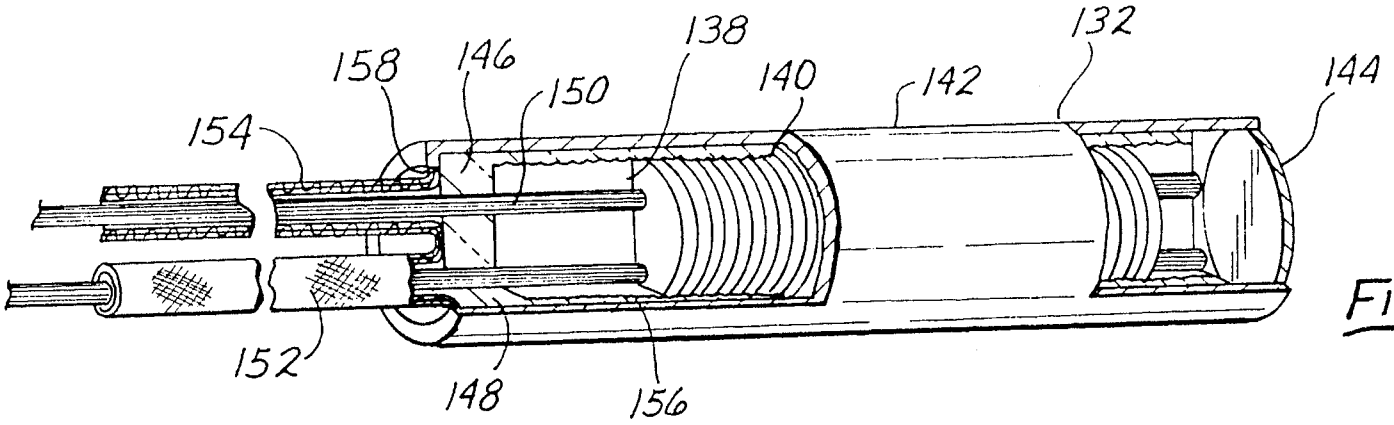
FIG. 6 is a perspective view, partly broken away and partly in section at line 7—7, of a heating element in accordance with the invention.

Defined in generator 120 is a receptacle 130 for receiving and accommodating a heating element cartridge 132 depicted in detail in FIG. 6. Heating cartridge 132 is affixed in receptacle 130 by means of cement of conventional type which is resistant to high temperatures. Receptacle 130 is open at both ends, traversing the length of generator 120. At a receiving end, receptacle 130 defines an aperture 134 which is dimensioned to receive cartridge 132; At its opposite end, receptacle 130 opens to aperture 136 that is preferably smaller than aperture 134. Aperture 136 is dimensioned to accommodate a pin or tamping member (not shown) for thrusting through receptacle 130 to the base of cartridge 132 thereby ejecting cartridge 132 when desired. Thus, a spent or broken cartridge can be removed for repair or replacement in an economical, cost efficient, and expeditious manner.

As depicted in FIG. 6, heating cartridge 132 is of generally cylindrical configuration. Cartridge 132 defines an included volume 138 which contains a coil of resistance wire 140. An outer sheath 142 of heating cartridge 132 is fabricated of high temperature alloy of conventional type. One end of heating cartridge 132 is closed by end plate 144; adjoining the opposite end of heating cartridge 132 is a terminal block 146. Terminal block 146 comprises a bracket for supporting a pair of leads 150, 152. Leads, 150, 152 are enclosed in temperature insulation sheaths 154, 156, respectively. Sheaths 154, 156 may be of standard material such as high temperature fiberglass for the purpose of protecting against the elevated temperatures produced by heating cartridge 132. Heating cartridge 132 has a seal 158 substantially flush with the end of cartridge 142 and comprising thermally insulated material such as epoxy or cement.

The entire generator 120 is sheathed in insulated material such as fiberglass (not shown). The heat generated is such that the entire generator normally heats to 500° F. and above, creating an oven-like effect surrounding the chamber 126 and its contents. A first thermostat 160 is positioned in thermal contact with generator 120; thermostat 160 is preferably set to turn off at approximately 500° F., plus or minus ten percent (10%). Electrical terminals 164 accommodate wires (not shown) connecting to the electrical system of system 10 so as to turn off the power to the heating element 132 when the desired temperature is reached. Preferably thermostat 160 is flush mounted to the generator 120 as, for example, by screwing the thermostat into a slot together with conventional means (not shown) to prevent slippage of thermostat 160.

A second thermostat 166 is depicted as positioned approximately 90° along the circumference of generator 120 from first thermostat 160. Other positions, of course, may be employed in accordance with the invention. Second thermostat 166 is mounted in generator 120 and has a pair of electrical terminals 168 connectable to the electrical system of the apparatus. As fully described hereinbelow, second thermostat 166 is set to cut off current to the heating cartridge 132 in the event of failure of first thermostat 160 such that the temperature of the chamber 126 shall not exceed 550° F.

Figure 7:
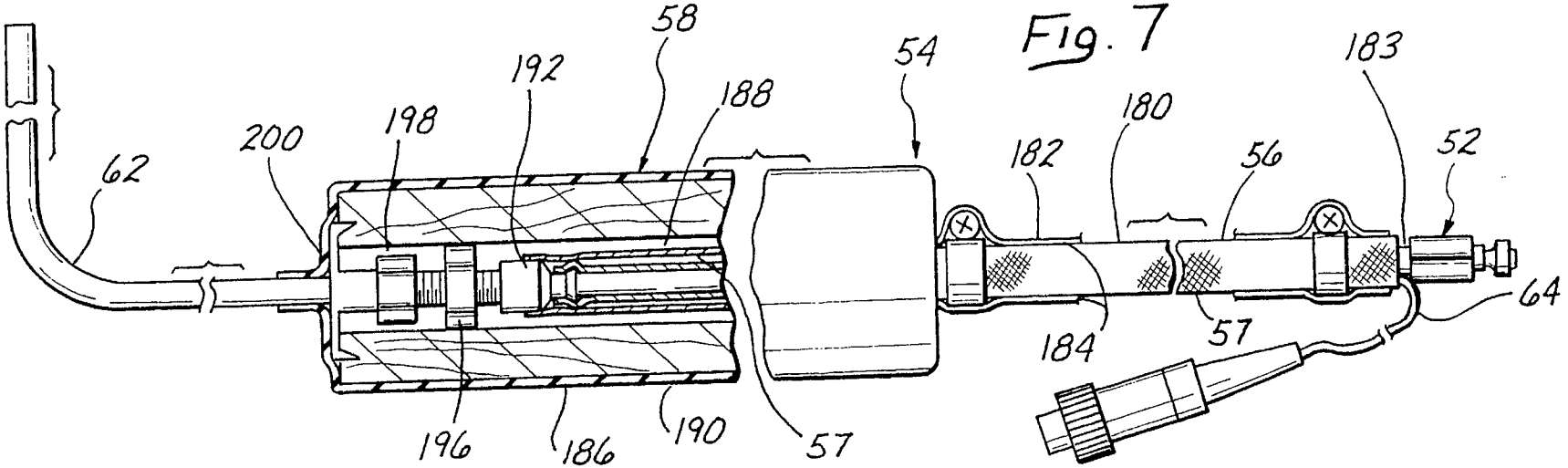
FIG. 7 is a perspective view, partly broken away, of a vapor control member in accordance with the invention.
Figure 6:
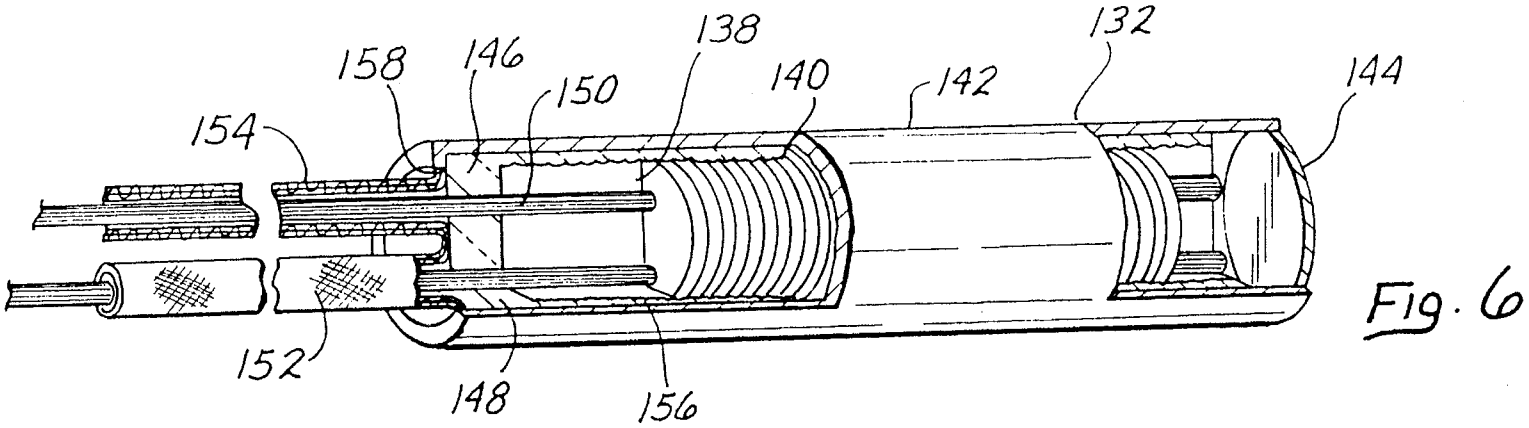
Figure 7:
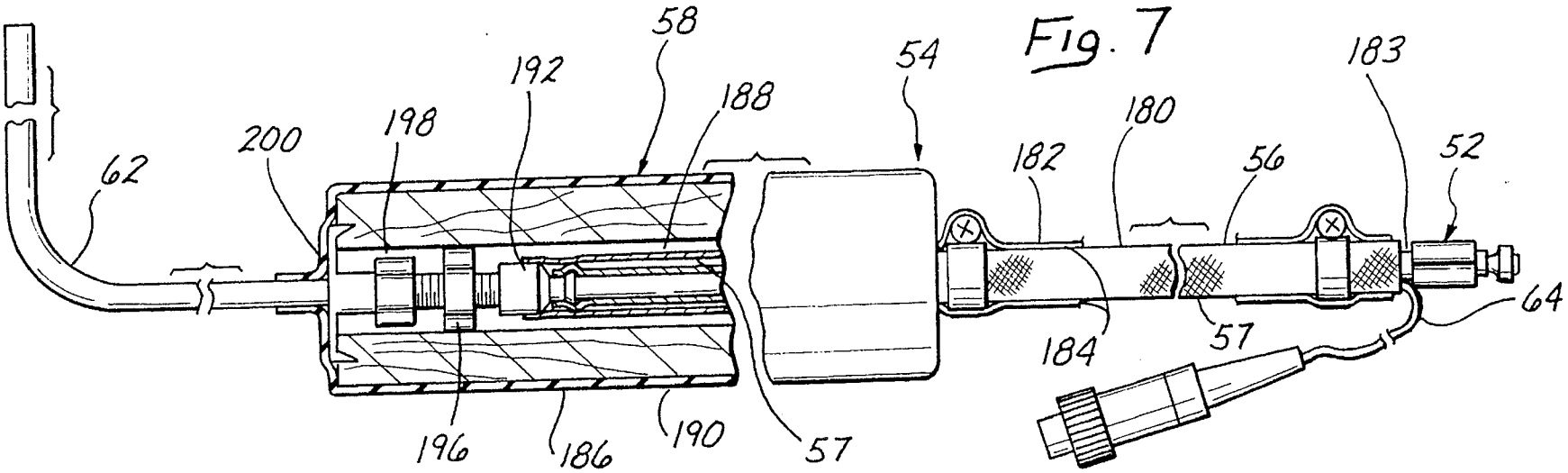

FIG. 7 depicts vapor control member or wand 56 in detail. Wand 56 comprises a conduit member 57, a handle member 58, and a tube 62 as previously discussed. The conduit 57 comprises braided steel cable 180 over hose 183 fabricated of heat resistant material such as that marketed under the trademark Teflon and in the preferred embodiment is substantially 42 inches long. An insulative sheath 182 is disposed over cable 180 and electrical wires 184 are disposed therebetween preferably Teflon-coated and covered by heat insulation tubing such as fiberglass.

Handle 58 includes a central bore 188. An insulator sheath 190 is disposed around handle 58. Insulation sheath 190 may comprise rubber or other conventional material.

Disposed within central bore 188 is a continuation of cable 180 covered by insulation 182 and wires 183, 184. Switch 60 controls the operation of wand 56. Switch 60 is of conventional type, for example a single-pole spring-operated mechanism. Conduit member 57 is fastened to tube 62 by fitting 198. Tube 62 is received in an aperture 200 at the outer end of handle 58 and may be fabricated of brass or other durable non-corrosible material.

Depicted in FIG. 10 in detail is check valve 90. Check valves 90,100 are identical to one another. Thus, the description herein is applicable to both. Check valve 90 defines a central bore 220 having at an input end an inlet 222 and an outlet 224 at an output end. The junction of inlet 222 and bore 220 is configured to form a seat 226 for a valve ball member 228 in bore 220. A valve cap member 230 disposed adjacent the outlet 224 defines a central bore 232 and is held by frictional engagement with inner walls 234 of bore 220. A valve spring 236 is disposed between ball 228 and cap member 230. It has been discovered that the liquid content of superheated vapor produced by the system 10 can be controlled by means of regulating check valves 90, 100 as, for example, by use of a thinner cap member 230 depressing the spring less (with smaller spring tension) such that less liquid is present in the superheated vapor whereas a thicker cap member (more spring tension) depresses the spring more, causing a greater proportion of liquid to be present in the superheated vapor.

The electrical circuitry for the system is depicted in FIG. 9. Power switch 18 controls the on/off condition of the entire system. Switch 24 is a manual vapor generator switch which as noted above is mounted on control panel 16. Wand switch 192 is actuated by push button 60 and like switch 24 controls vapor generation but is contained in the wand 56 for ease of operation of the device. Switches 24, 192 control the on/off condition of pump motor 72. A terminal block 202 is fastened to base plate 12 and contains terminals 204 which provide electrical connections for the electrical circuitry of system 10.

A spark suppressor 206 is depicted as being connected with first thermostat 160 and second thermostat 166. The purpose of spark suppressor 206 is to prevent the respective thermostats from arcing. In the event that the spark suppressor 206 and the first thermostat 160 should fail, creating the danger of overheating and destruction of the unit, the second thermostat 166 at 550° F. will cut off. A thermofuse 207 cuts in upon failure of the second thermostat 166 and, will break the generator circuit at 650° F.

Red light 26 is connected to be on when the first thermostat 160 has cut out while the second thermostat 166 continues to operate, thus notifying the operator of a change in condition in the system.

The white light 22 is illuminated when power switch 18 is closed (i.e. when the power switch is turned on). The amber light 36 is on when heating element 132 is drawing current. Light 36 remains on so long as heating element 132 draws current. When light 36 goes out, this indicates that generator 120 has reached its operating temperature. A foot jack switch control 208 is connected to and mounted upon the foot switch receptacle 28 on panel 16 and performs the same function as switches 24, 192. Removeable power line fuse 20 is depicted as in series with power switch 18. A relay arrangement may be employed to supply current to the heating element immediately upon actuation of any of the vapor control switches so as to maintain, in conjunction with the thermostats, a substantially constant power supply and temperature for vapor generation.

Heating cartridge 132 preferably delivers substantially 1000 watts of power to maintain temperature of the vapor generator 120 at 500° F. Other power delivery rates and operating temperatures, higher and lower, may be employed in accordance with the invention. The motor RPM is substantially equal to 366 and the pump delivery rate is preferably 4.9 gallons per hour. Other motor RPM and pump delivery rates may be employed in accordance with the invention.

The foregoing dimensions are exemplary only of the preferred embodiment and, of course, other specific dimensions may be employed in accordance with the invention.

In operation, system 10 is connected by hose 40 to a source of liquid (not shown). The liquid may be any of a broad range related to the purposes for which the system 10 is to be used. In a typical cleaning context in which the system is employed to loosen and dissolve dirt as on machinery or circuit boards or in corners of a room, 100% undiluted water, distilled or deionized, may be employed. Additives such as detergents or disinfectants may be employed provided that they are stable at the operating temperatures of the system. The proportions of additives and water may be varied depending on the application. The solution may contain vaporizers, emulsifiers, degreasers, oxidants, alkalis, deodorizers, antiseptics, germicides, or the like. In addition, the liquid may comprise humidifiers, fresheners, and other reagents which the user may wish to impart to the air or to a surface or object.

Particular applications of the system include cleaning of equipment, circuit boards and/or surfaces and spaces such as rooms in connection with maintenance or janitorial work. Wand 56 provides the capability for precise direction of the vapor flow even to small objectives and in particular allows impingement of the vapor into small, confined, or relatively inaccessible objects or spaces. Apparatus in accordance with the invention provides a general purpose cleaning capability with particular applicability to remote or relatively inaccessible areas, objects and small parts.

The invention may be employed in connection with burnishing or cleaning of small parts such as time-piece apparatus, in connection with metal plating, printing and photo-engraving, lapidary and stone cutting activity, manufacture and/or repair of electronic components, removal of such things as wallpaper, labels and the like, in connection with dry-cleaning, sanitizing and sterilizing of eating implements, in connection with optical and optometric laboratory and office work, with jewelry, dental and medical offices and operating theatres, miniature instrument manufacture and repair, and biological and analytic laboratories, among many other applications. Use of apparatus in accordance with the invention is particularly advantageous in that its flexibility permits cleaning of small parts to be accomplished with a minimum of disassembly.

A particularly useful application of the invention is in connection with the cleaning and maintenance of military equipment, including weapons and related items. This has become timely in view of the current emphasis on repair and maintenance as opposed to acquisition of new items.

The system 10 preferably operates at substantially 1000 watts at 120 or 240 volts. When the power switch 18 is turned to the on position, the white signal light 20 and the amber light 36 are illuminated. As indicated, illumination of light 22 indicates that power is being provided to the system and light 36 indicates that the heating cartridge 132 of the vapor generator 120 is drawing current. When vaporization chamber 124 reaches the desired temperature of 500° F., indicator light 136 goes out under the influence of the first thermostat 160. This informs the operator that superheated steam or other vapor is available.

As noted any one of switches 24, 38, 192 can be actuated to cause the issuance of vapor from tube 62. When the machine "warms up", a period of 8–9 minutes is normally sufficient for the chamber 126 to reach operating temperature for generation of superheated vapor.

The operator directs the tube 62 toward the object which is to receive superheated vapor,which issues from tube 62. The superheated vapor such as steam, is "dry" i.e. having a high proportion of gas as opposed to content of fluid droplets. This has a favorable effect in that the amount of liquid included in the vapor is so small that the residue does not interfere with further cleaning and does not require a cleanup, the amount of fluid residue being so small that it can normally be readily removed by a cloth or paper towel. Pooling of liquid is virtually eliminated. The material removed by a towel in the form of a residue is easily disposed of, particularly in cases where any removed contaminants are non-hazardous or non-toxic.

By use of the invention, the operator gains the capability of precisely directing relatively dry vapor to the object targeted. The operator can control the amount of heat transferred to any target by varying the distance between the end of the tube 62 and the object of the heat, decreasing the distance and increasing the heat applied, increasing the distance and decreasing the heat applied. The invention produces a jet of superheated vapor of a temperature of approximately 500° F. at the nozzle and for a short distance. It has been found that approximately three inches from the nozzle the vapor has cooled sufficiently that human flesh will not be burned by it.

Superheated vapor issues at approximately 120 PSI. As a result of this, the superheated vapor impinges upon, and into such relatively hard-to-reach spaces as portholes, crevices, and the like. Application of heat causes contaminants to soften, liquify, and generally decompose or disengage from the surfaces on which they are disposed. This applies to such normally hard-to-clean substances as grease, oil, grime, paste, glue, and carbon. A burst of superheated vapor, such as steam in a cleaning context, lasting 5–10 seconds, is sufficient for many cleaning purposes. In the preferred embodiment, the burst of superheated vapor produced by the system 10 will last approximately 15–30 seconds. For removal of tenacious contaminants, heat applied by the invention initiates cleaning. Then a cleaner or emulsifier may be applied in conventional fashion at which point a further burst of superheated vapor from the invention completes removal of the contaminant.

Other applications for the invention are, among others, lubrication, particularly of relatively inaccessible and small parts. Lubrication applied in this manner is a most effective type of hot lubrication in that the surface having been first cleaned by use of the invention in a cleaning mode, then lubricant can be applied by disposing lubricant on the now clean, heated parts by conventional means and then subjecting the part to a burst of superheated vapor, causing the lubricant to be dispersed evenly throughout and upon the object to be lubricated.

Actuation of one of the switches 24, 38, or 192 activates electric motor 86 which in turns drives pump 72. The configuration of the pump 72 and in particular the cam 82 is such as to inhibit vapor lock in the fluid line which might be caused by the heat in the system. In addition, the cam arrangement enables a more effective combatting of back pressure of the vapor as it builds up within the generator 120. This allows steam to exit tube 62 in a burst with greater force at times even than the rated 120 PSI and for a longer vapor flow, with the back pressure under control.

As a result of the action of pump 72, liquid is drawn into the system 10 through conduit 40. The liquid proceeds through conduit 40 and into pipe 88. Check valve 90 inhibits any tendency to back flow and at the same time prevents intake of solids. The liquid then passes through T-fitting 94 and through second check valve 100. The liquid then passes into the superheated vapor generator 120 and into chamber 126 and very rapidly vaporizes to form superheated vapor.

A method for fabricating a superheated vapor generator in accordance with the invention is depicted FIG. 11. Two separate, preferably semicylindrical, parts are provided. One part may have a longer axial extent than the other for purposes of accommodating a heating cartridge and providing sufficient heat dissipative area to prevent undue heat and temperature build-up. The longer part defines a slot or receptacle for a heating cartridge.

The parts have hollow sections comprising the heating chamber. The hollow interior section of the parts may be either cast or machined to define a series of ridges and grooves of randomly varying heights and depths in a manner such that they are concentric or helical about the longitudinal axis of the part.

Radial grooves are then machined in the parts, such grooves also having varying depths and heights. In the embodiment depicted, the radial grooves may be 10–12 in number, though other quantities may be utilized in accordance with the invention.

The parts are then welded together and may be fastened within a housing of a system in accordance with the invention.

As described hereinabove, there has therefore been provided an improved vapor generator and control system together with a method for fabrication of an element thereof. Though a preferred embodiment has been described and depicted herein, the scope of the invention is defined by the appended claims interpreted in light of the specification and drawings.

What is claimed is:

1. A superheated vapor generating and control system comprising:

(1) at least one vapor generator member, said vapor generator member defining an internal vaporizing chamber, said vaporizing chamber having a peripheral surface at least a portion of which includes a plurality of ridges and grooves, the height and depth of said ridges and grooves varying substantially randomly;

(2) at least one heating element member in thermal contact with said vaporizing chamber and connectable to a source of power for heating said heating element thereby to heat said vaporizing chamber; and (3) means for supplying liquid for vaporizing to said vaporizing chamber.

2. The invention as set forth in claim 1 wherein the height and depth of said ridges and grooves is substantially in the range of 0.030–0.050 inch.

3. The invention as set forth in claim 1 wherein at least one ridge and groove intersect with said first-mentioned ridges and grooves.

4. The invention as set forth in claim 3 wherein said second-mentioned at least one intersecting ridge and groove constitute a plurality, varying substantially randomly in height and depth.

5. The invention as set forth in claim 4 wherein said heights and depths of said second-mentioned ridges and grooves vary substantially in the range of 0.025–0.030 inch.

6. The invention as set forth in claim 1 wherein said ridges and grooves form substantially concentric circular configurations and further including a second plurality of ridges and grooves intersecting said first-mentioned ridges and grooves substantially at right angles.

7. The invention as set forth in claim 6 further including a vapor control member for controlling the generation of superheated vapor by said vapor generator member and for directing said superheated vapor to desired objectives.

8. A system for generating and controlling superheated vapor comprising:

(1) a vapor generator member for producing superheated vapor from liquid and connectable to input means supplying liquid and to output means for issuance of superheated vapor therefrom; and (2) at least one vapor control member connectable to said output means of said vapor generator member, said vapor control member including means for directing superheated vapor toward a desired object and means for controlling generation of superheated vapor by said vapor generator member, said input means including check valve means comprising at least one spring member disposed between at least one valve ball member and at least one valve cap member, whereby when said valve cap member is thicker thereby increasing spring tension, moisture content of said superheated vapor is increased and when said valve cap is thinner thereby reducing spring tension, the liquid content of vapor generated by said vapor generator member is smaller.

9. The invention as set forth in claim 8 wherein said pump is electrically powered and wherein said means for controlling said vapor generator on said vapor control member comprises an electrical switch for controlling the on-off condition of said pump.

10. The invention as set forth in claim 8 wherein said vapor control member comprises a hand-holdable and manipulable member comprising a handle and a nozzle, and wherein said means for controlling vapor generation comprises an on-off switch in said handle.

11. The invention as set forth in claim 10 wherein said vapor control member comprises a substantially flexible conduit connected between said handle and said output means of said vapor generator member, whereby mobility of the vapor control member and vapor directed thereby is facilitated.

12. The invention as set forth in claim 8 wherein said vapor generator member includes a vapor generation chamber comprising a substantially hollow volume defined within said vapor generator member and having at least one peripheral surface comprising a plurality of ridges and grooves.

13. The invention as set forth in claim 12 wherein the depth of said ridges and grooves varies randomly.

14. The invention as set forth in claim 12 wherein the depth of said ridges and grooves varies randomly in the range of 0.030–0.050 inch.

15. The invention as set forth in claim 8 wherein said input means includes check valve means adjustable to vary the liquid content of superheated vapor generated by said vapor generator member.

16. The invention as set forth in claim 8 wherein said liquid comprises water and said superheated vapor comprises superheated steam.

17. The invention as set forth in claim 8 wherein said liquid comprises a cleaning solution.

18. The invention as set forth in claim 8 wherein a lubricant is placed on a surface of said vapor generator member to receive superheated vapor for distribution of said lubricant thereon.

19. The invention as set forth in claim 8 further including a heating element in thermal contact with said vapor generator member for supplying heat thereto, said heating member being responsive to a thermostat to maintain the temperature of said vapor generator member at a predetermined level.

20. The invention as set forth in claim 19 wherein said vapor generator member is set to operate within a range of 500° F. plus or minus ten percent (10%).

21. The invention as set forth in claim 19 further including a second thermostat member for regulating the temperature of said vapor generator member when the temperature thereof exceeds the limits set by said first-mentioned thermostat member.

22. The invention as set forth in claim 21 wherein the said second thermostat member regulates temperature of said vapor generator member substantially within a range of 550° F. plus or minus ten percent (10%).

23. The invention as set forth in claim 22 further including first indicator means to indicate drawing of power to heat said vapor generator member to its pre-set operating temperature range.

24. The invention as set forth in claim 21 further including a thermofuse member for interrupting power supply to said heating member when the range of operating temperatures of said second thermostat member is exceeded, whereby to halt operation of the vapor generator member.

25. The invention as set forth in claim 19 wherein said heating element comprises a removeable heating member in the form of a cartridge and wherein said vapor generator member defines at least one slot for receipt of said cartridge.

26. The invention as set forth in claim 8 wherein said intake means includes at least one conduit member between said pump and said vapor generator member, said conduit including a thermally conductive sleeve at a section thereof where said conduit enters said vapor generator member, to minimize the erosive effect of the temperature differential between the interior of said vapor generator member and the said conduit member outside said vapor generator member.

27. The invention as set forth in claim 8 wherein said vapor generator member is composed of aluminum.

28. The invention as set forth in claim 8 wherein said vapor generator member is composed of thermally conductive material.

29. A vapor generator for generating superheated vapor comprising:

A vapor generating chamber defined within a body of thermally conductive material, the periphery of said vapor generator chamber comprising a plurality of ridges and grooves, the height and depth of said ridges and grooves varying substantially randomly.

30. The invention as set forth in claim 29 wherein said vapor generator comprises at least two sections welded together to form said vapor generator chamber.

31. The invention as set forth in claim 29 further including a plurality of grooves and ridges intersecting at least some of said first mentioned grooves and ridges.

32. The invention as set forth in claim 31 wherein said intersections of said second-mentioned grooves and ridges with said first-mentioned grooves and ridges are substantially perpendicular.

33. The invention as set forth in claim 29 wherein said grooves and ridges comprise substantially concentric circles.

34. The invention as set forth in claim 33 further including a plurality of grooves and ridges substantially intersecting at least some of said first-mentioned grooves and ridges.

35. The invention as set forth in claim 34 wherein the said intersections of said first-mentioned grooves and said second-mentioned grooves and ridges are essentially perpendicular.

36. The invention as set forth in claim 29 wherein said vapor generator chamber is substantially spherical in configuration.

37. A method for fabricating a vapor generator comprising the steps of:

(1) Providing at least two (2) sections of a thermally conductive material configured to be fittable together to form a closed interior volume;

(2) Machining the interior of said sections to provide a plurality of ridges and grooves of the inner surface of said parts, said grooves and ridges being machined to provide a random variation of height and depth;

(3) Welding said parts together to form a closed volume.

38. The method as set forth in claim 37 further including the step of machining said parts to provide a plurality of ridges and grooves intersecting at least some of said first-mentioned ridges and grooves.

39. The method as set forth in claim 37 wherein said variation of depth and height is substantially in the range of 0.030–0.050 inch.

40. The invention as set forth in claim 37 wherein said intersecting ridges and grooves have a random variation of depth and height.

41. The invention as set forth in claim 40 wherein said grooves and ridges vary in the range of substantially 0.025–0.035 inch.

* * * * *